US007554038B2

(12) United States Patent
Oga et al.

(10) Patent No.: US 7,554,038 B2
(45) Date of Patent: Jun. 30, 2009

(54) SHIELD WIRE

(75) Inventors: Tatsuya Oga, Shizuoka (JP); Hidehiro Ichikawa, Shizuoka (JP); Shigemi Hashizawa, Shizuoka (JP); Koji Nomura, Aichi (JP); Masahiro Takamatsu, Aichi (JP); Akihito Tsukamoto, Aichi (JP); Sou Arikawa, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/802,084

(22) Filed: May 18, 2007

(65) Prior Publication Data

US 2007/0267208 A1 Nov. 22, 2007

(30) Foreign Application Priority Data

May 19, 2006 (JP) ..... 2006-140160

(51) Int. Cl.
*H01B 7/00* (2006.01)
*H01B 7/22* (2006.01)

(52) U.S. Cl. ..... 174/102 R; 174/102 SP; 174/105 R; 174/107

(58) Field of Classification Search ..... 174/102 R, 174/102 SP, 106 R, 113 R, 121 A, 121 SR; 333/237

See application file for complete search history.

(56) References Cited

U.S. PATENT DOCUMENTS

| | | | | | |
|---|---|---|---|---|---|
| 2,391,037 | A | * | 12/1945 | Shafer, Jr. | 174/102 SP |
| 3,206,536 | A | * | 9/1965 | Goodloe | 174/357 |
| 4,325,039 | A | * | 4/1982 | Allebone | 333/237 |
| 4,678,699 | A | * | 7/1987 | Kritchevsky et al. | 428/175 |
| 5,247,270 | A | * | 9/1993 | Harman et al. | 333/237 |
| 5,276,413 | A | * | 1/1994 | Schulze-Buxloh | 333/237 |
| 5,422,614 | A | * | 6/1995 | Rampalli et al. | 333/237 |
| 5,467,066 | A | * | 11/1995 | Schulze-Buxloh | 333/237 |
| 5,705,967 | A | * | 1/1998 | Pirard | 333/237 |

FOREIGN PATENT DOCUMENTS

| | | |
|---|---|---|
| JP | 6-41028 | 5/1994 |
| JP | 2003-115223 | 4/2003 |

* cited by examiner

*Primary Examiner*—William H Mayo, III
(74) *Attorney, Agent, or Firm*—Kratz, Quintos & Hanson, LLP

(57) ABSTRACT

A shield wire has one covered wire, a metal foil shield wound around the covered wire, and a sheath covering around the metal foil shield and a sheath covering around the metal foil shield. In the metal foil shield, slits are formed linearly along a lengthwise direction of a core. The slits adjacent to each other with a space in a direction intersecting the lengthwise direction of the core are staggered along the lengthwise direction

3 Claims, 7 Drawing Sheets

PRIOR ART

PRIOR ART

SHIELD WIRE

BACKGROUND OF THE INVENTION

1. Field of the Invention

This invention relates to a shield wire having a function for shielding the wire from an electromagnetic noise.

2. Description of the Related Art

A wiring harness for supplying electric power and control signals from a power source and a controller to electronic apparatuses, such as various lamps and various motors mounted in an automobile as a vehicle is wired. The wiring harness includes a plurality of electric wires and terminals connected to ends of the electric wires. The wiring harness includes a shield wire as one of the electric wires (shown in FIGS. 9, 10, refer Patent documents 1, 2).

The shield wire 101A shown in FIG. 9A includes a covered wire 120 provided by covering an electrical conductive core 102 with an insulation cover 103, a braid shield 104 provided around an outer surface of the covered wire 102, and an insulating sheath 105 covering an outer surface of the braid shield 104. The braid shield 104 is formed into a tube shape by braiding metal element wires wound in respective bobbins 200 to cross each other as shown in FIG. 9B. The braid shield 104 is connected to a required earth circuit. The shield wire 101A structured as described above flows an external noise, which would go into the covered wire 120, through the braid shield 104 to the earth circuit so that it is prevented that the external noise goes into the core 102 of the covered wire 120.

The shield wire 101B shown in FIG. 10 includes the covered wire 120 provided by covering the electrical conductive core 102 with the insulation cover 103, a drain wire 107, a metal foil shield 106 wound around both the outer surface of the covered wire and the drain wire 107, and the insulating sheath 105 covering an outer surface of the metal foil shield 106. The drain wire 107 contacting with the metal foil shield 106 is connected to the required earth circuit. The shield wire 101B structured as described above flows the external noise, which would go into the covered wire 120, through the metal foil shield 106 and the drain wire 107 to the earth circuit so that it is prevented that the external noise goes into the core 102 of the covered wire 120.

The shield wire 101C shown in FIG. 11 includes a wire bundle 108 bundling a plurality of covered wires and the drain wire, and a strip-shaped conductive foil sheet 110 wound spirally around an outer surface of the wire bundle 108. The covered wire (not shown) is structured as same as the covered wire 120 forming the shield wire 101B shown in FIG. 10. The conductive foil sheet 110 includes a thin conductive layer and a thin insulation layer provided on the conductive layer so as to be formed into a relatively thin strip shape. The conductive foil sheet 110 is wound around the wire bundle 108 so as to make the conductive layer touch the drain wire. The drain wire touching the conductive layer is connected to the required earth circuit. The shield wire 101C structured as described above flows the external noise, which would go into the covered wire 120, through the conductive layer of the conductive foil sheet 110 and the drain wire to the earth circuit so that it is prevented that the external noise goes into the core of the covered wire. Refer Patent documents of Japan Published Patent Application No. 2003-115223 and published Japan Utility Model Application No. H06-41028.

SUMMARY OF THE INVENTION

Objects to be Solved

Since the braid shield 104 is extensible, the aforesaid shield wire 101A has a good flexibility. However, since the braid shield wire 101A is manufactured by braiding the element wire 141 as mentioned above, the manufacturability is low and the manufacturing cost becomes high. On the other hand, the shield wires 101B and 101C can be manufactured on the cost lower than the shield wire 101A. However, since the metal foil shield 106 and the conductive foil sheet 110 are not extensible, the shield wires 101B, 101C have a poor flexibility.

According to the above problem, an object of the present invention is to provide a shield wire, which can be manufactured in low cost and has a good flexibility.

How to Attain the Object of the Present Invention

In order to overcome the above problems and attain the object of the present invention, a shield wire is characterized in that the shield wire includes a covered wire having an electrical conductive core and a cover covering the core, a metal foil shield winding around an outer surface of the covered wire, and a sheath covering around the metal foil shield, and the metal foil shield is provided with a plurality of slits penetrating the metal foil shield.

The shield wire is more characterized in that the slits are formed linearly along a lengthwise direction of the core, and the slits adjacent to each other with a space in a direction intersecting the lengthwise direction of the core are staggered along the lengthwise direction of the core.

The shield wire is further characterized in that the slits are formed linearly along a direction intersecting a lengthwise direction of the core, and the slits adjacent to each other with a space in the lengthwise direction of the core are staggered along the direction intersecting the lengthwise direction of the core.

EFFECTS OF INVENTION

According to the shield wire of the present invention, since the metal foil shield is made extensible by the slits, the shield wire with a good flexibility can be provided by using the metal foil shield.

Since the extensible metal foil shield is used, the metal foil shield can be wound without creases from a front side toward a rear side of the shield wire along a manufacturing flow in a manufacturing line of the shield wire. Therefore, the shield wire can be formed by extruding the sheath around a part of the covered wire wound with the metal foil shield along the manufacturing flow, so that the manufacturability is improved.

According to the shield wire of the present invention, the slits are formed linearly along the lengthwise direction of the core, and the slits adjacent to each other with the space in the direction intersecting the lengthwise direction of the core are staggered along the lengthwise direction of the core. Thereby, the slits can be expanded like a mesh so as to make the metal foil shield extensible along the direction intersecting the lengthwise direction of the core.

According to the shield wire of the present invention, the slits are formed linearly along the direction intersecting the lengthwise direction of the core, and the slits adjacent to each other with the space in the lengthwise direction of the core are staggered along the direction intersecting the lengthwise direction of the core. Thereby, the slits can be expanded like a mesh so as to make the metal foil shield extensible along the lengthwise direction of the core.

The above and other objects and features of this invention will become more apparent from the following description taken in conjunction with the accompanying drawings.

DESCRIPTION OF THE PREFERRED EMBODIMENT

A first embodiment according to the present invention will be described with reference to FIGS. 1-4.

Figure 1:
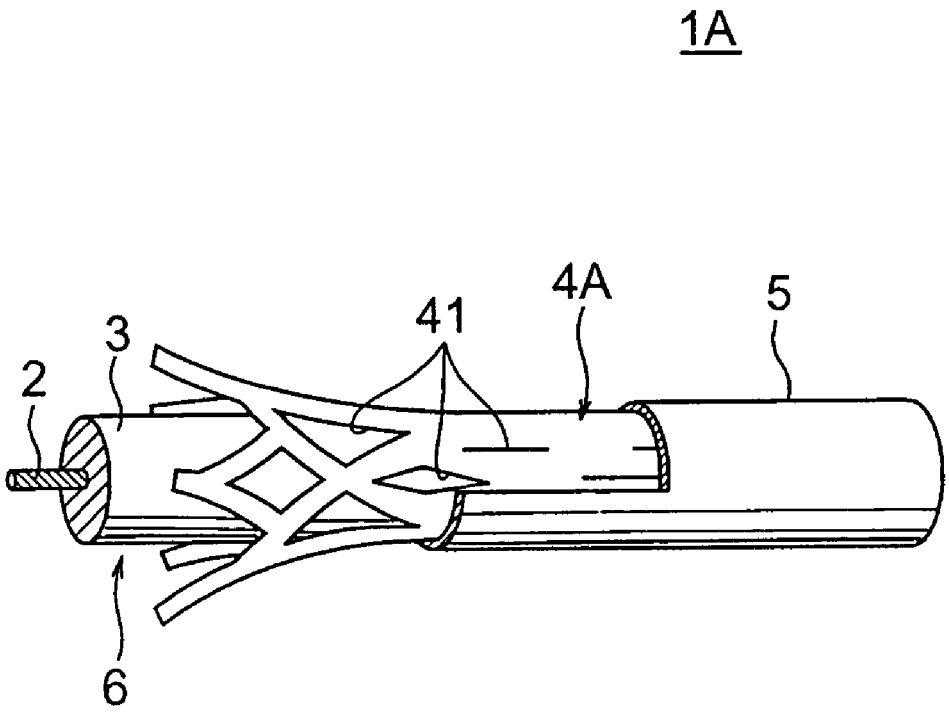
FIG. 1 is a perspective view of a shield wire of a first embodiment according to the present invention.
Figure 2:
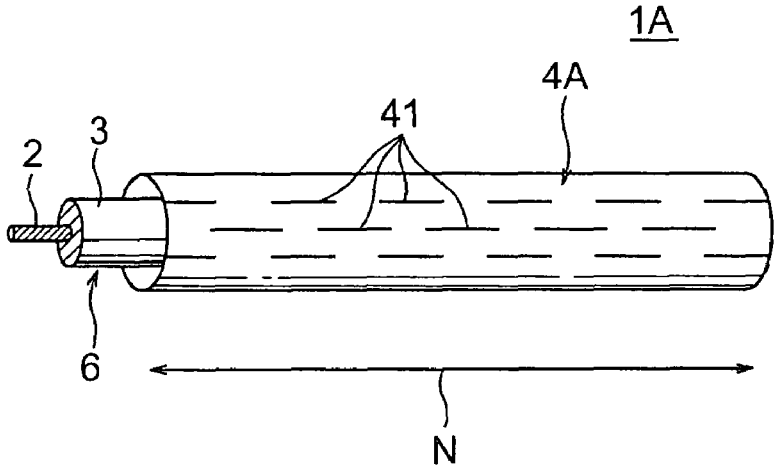
FIG. 2 is a perspective view showing a metal foil shield of the shield wire shown in FIG. 1.

A shield wire 1A, as shown in FIG. 2, includes one covered wire 6 formed by covering a conductive core 2 with a cover 3, a metal foil shield 4A wound around an outer surface of the covered wire 6, and a sheath 5 covering an outer surface of the metal foil shield 4A.

The core 2 is formed with a round shape cross section by stranding conductive wire elements made of an electrical conductive metal such as copper or copper alloy. In short, the core 2 is a stranded wire. The cover 3 is made of insulation synthetic resin to cover the core 2 for insulation. The covered wire 6 structured by the core 2 and the cover 3 is formed into a round shape in a cross section. The sheath 5 is made of the insulation synthetic resin and formed by extruding so as to cover an outer surface of the metal foil shield 4A.

The metal foil shield 4A is formed into a thin strip shape with a conductive layer of a conductive metal consisting of aluminum or aluminum alloy and a synthetic thin film provided on the conductive layer. The synthetic film is provided for enforcing the conductive layer. The metal foil shield 4A is wound like a tube around an outer surface of the covered wire 6 so as to make the synthetic film touch the cover 3, and to be arranged inside the sheath 5.

The metal foil shield 4A is provided with slits 41 formed linearly along a lengthwise direction N of the core 2 as shown in FIG. 2. The slits 41 penetrate through both the conductive layer and the synthetic layer. The slits 41 adjacent to each other with a space in a direction K (shown in FIG. 3) perpendicular to (intersecting) the lengthwise direction N are staggered along the lengthwise direction N.

Figure 3:
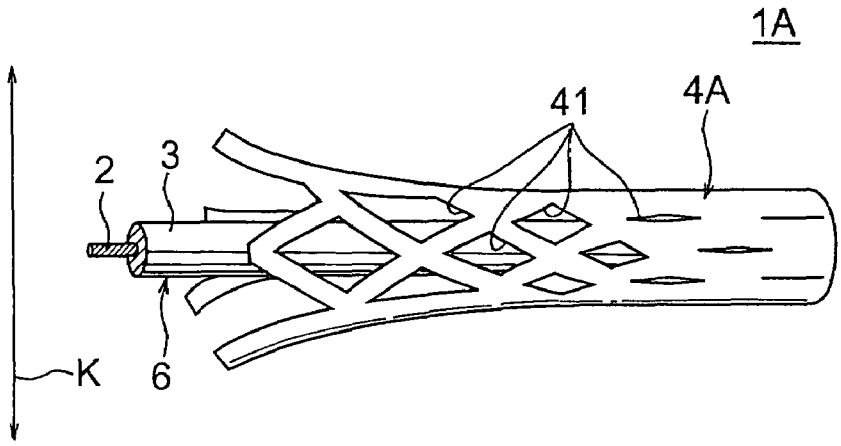
FIG. 3 is an illustration for explaining flexibility of the metal foil shield shown in FIG. 2.
Figure 4:
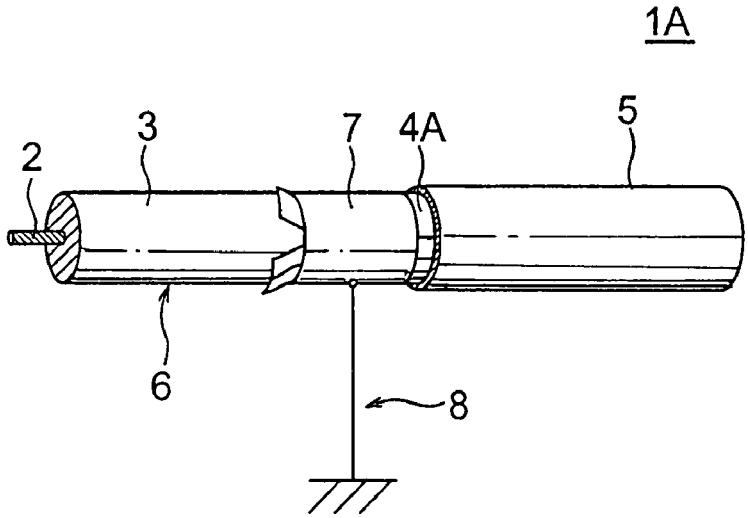
FIG. 4 is an illustration for explaining terminal treatment of the metal foil shield shown in FIG. 1.

The metal foil shield 4A becomes extensible in the direction K perpendicular to the lengthwise direction N, that is a circumferential direction of the covered wire 6 as shown in FIG. 3, by the slits 41 expanding. When the shield wire 1A is extended linearly, the slits 41 are closed and when the shield wire 1A is bent, the slits 41 are opened. The shield wire 1A structured with such metal foil shield 4A has a good flexibility.

The cover of an end of the shield wire 1A structured above is removed to expose the core 2 to be joined with a terminal for wiring and connected to a mating terminal. An end of the metal foil shield 4A exposed by removing the sheath 5 is fitted with a ring-shaped conductive member 7 for connecting to a required earth circuit 8. This terminal treatment of the metal foil shield can be processed as a usual braid shield wire.

Such shield wire 1A will be used in the wiring harness and pass outer noises, which would penetrate into the core 2 of the covered wire 6, through the conductive layer of the metal foil shield 4A to the earth circuit 8, that is outside of the shield wire 1A.

The shield wire 1A is manufactured as following. The core 2 is formed by stranding element wires. The covered wire 6, in which the cover 3 covers around the core 2, is formed by extruding synthetic resin around the core 2 from one end of the core 2 in a lengthwise direction N of the core 2 (a front end of the core 2 in a direction of transferring the core 2) to the other end of the core 2 (a rear end of the core 2 in the direction of transferring the core 2). The metal foil shield 4A is wound around the covered wire 6 from one end of the covered wire 6 in the lengthwise direction N of the covered wire 6 (a front end of the covered wire 6 in a direction of transferring the covered wire 6) to the other end of the covered wire 6 (a rear end of the covered wire 6 in the direction of transferring the covered wire 6) so as to form the metal foil shield around the covered wire 6 in a body.

According to the embodiment, since the metal foil shield 4A is made extensible by the slits 41, the shield wire 1A with a good flexibility can be provided by using the metal foil shield 4A. The metal foil shield 4A can be connected directly to the earth circuit 8 as the usual braid shield wire. Thereby, the drain wire is not required, and the shield wire can be manufactured in lower cost as compared with the braid shield wire, so that the shield wire 1A can be provided in a low price.

The good flexible metal foil shield 4A can be wound without creases gradually around the covered wire 6 from the front end to the rear end of the covered wire 6 in the direction of transferring the covered wire 6 in a manufacturing line. Therefore, the sheath can be formed by extruding in order around a part wound with the metal foil shield of the covered wire, so that the manufacturability is improved.

A second embodiment according to the present invention will be described with reference to FIGS. 5-8. The same components as the aforesaid first embodiment in FIGS. 5-8 are put with the same remarks and description about that is omitted.

Figure 5:
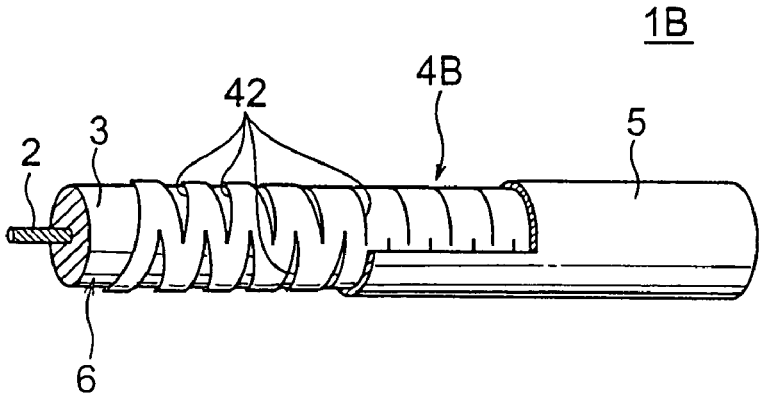
FIG. 5 is a perspective view of a shield wire of a second embodiment according to the present invention.
Figure 6:
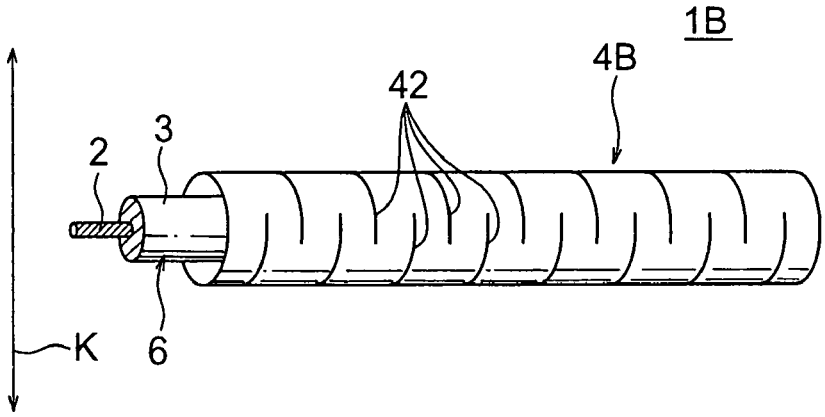
FIG. 6 is a perspective view showing a metal foil shield of the shield wire shown in FIG. 5.
Figure 7:
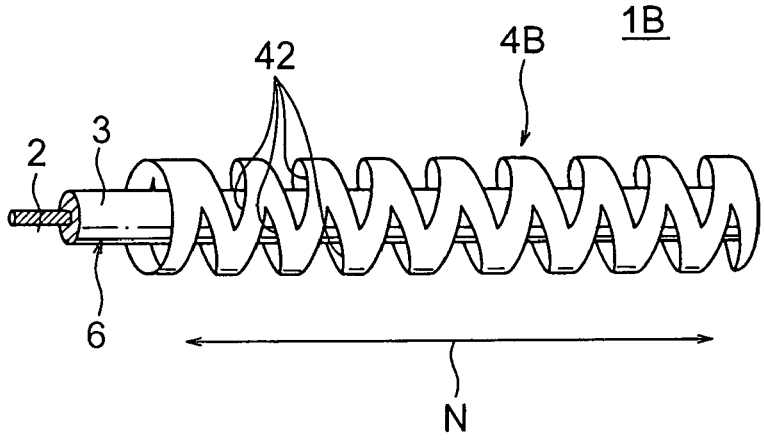
FIG. 7 is an illustration for explaining flexibility of the metal foil shield shown in FIG. 5.

A shield wire 1B according to the embodiment shown in FIG. 5 is structured with a metal foil shield 3B shown in FIGS. 6 and 7. The metal foil shield 4B is provided with slits 42 formed linearly along the direction K perpendicular to the lengthwise direction N of the core 2. The slits 42 penetrate through both the conductive layer and the synthetic layer. The slits 42 adjacent to each other with a space in the lengthwise direction N perpendicular are staggered along the perpendicular direction K.

The metal foil shield 4B becomes extensible in the lengthwise direction N by the slits 42 expanding like a mesh. When the shield wire 1B is extended linearly, the slits 42 are opened and when the shield wire 1B is bent, the slits 42 are closed. The shield wire 1B structured with such metal foil shield 4B has a good flexibility.

Figure 8:
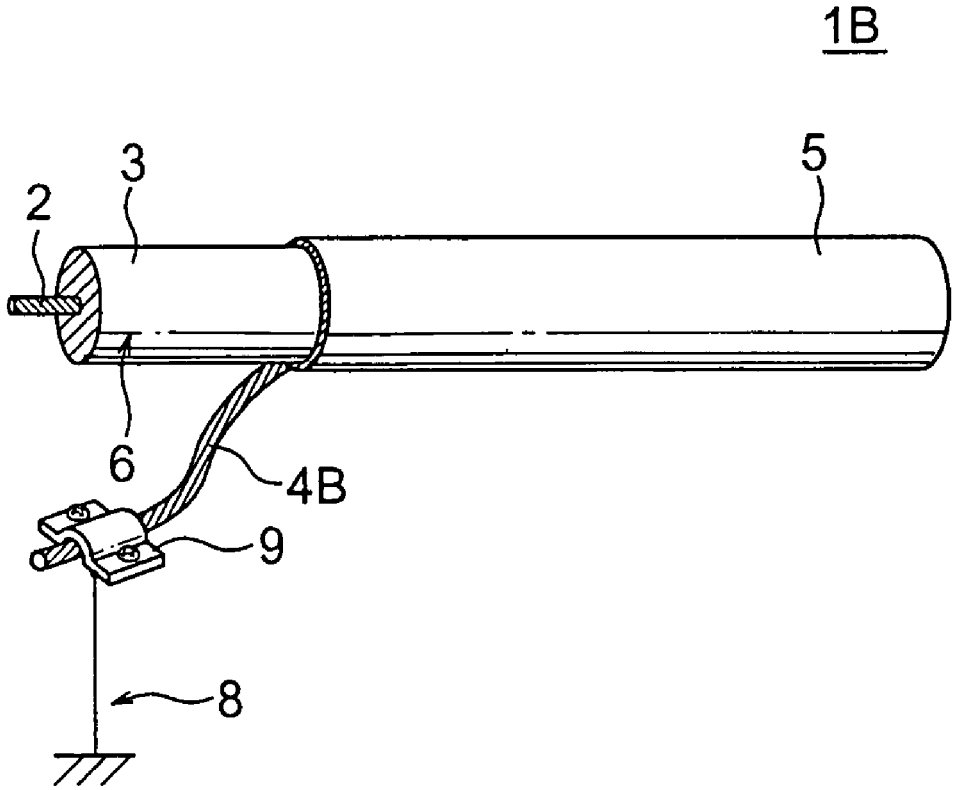
FIG. 8 is an illustration for explaining terminal treatment of the metal foil shield shown in FIG. 5.
Figure 9A:
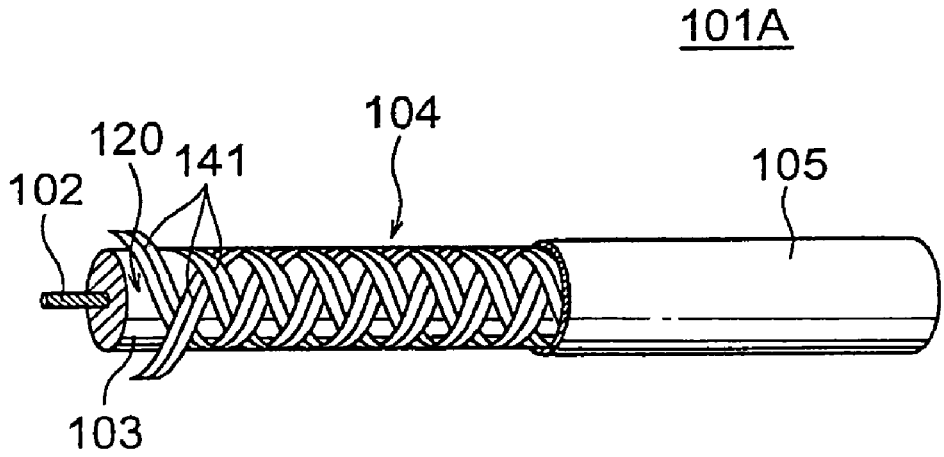
FIG. 9A is a perspective view of a shield wire including a usual braid shield.
Figure 9B:
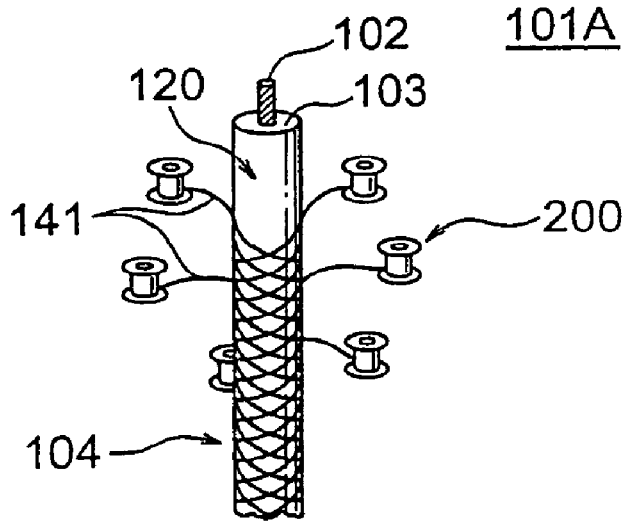
PRIOR ART FIG. 9B
FIG. 9B is an illustration for explaining manufacturing method of the braid shield wire shown in FIG. 9A.
Figure 10:
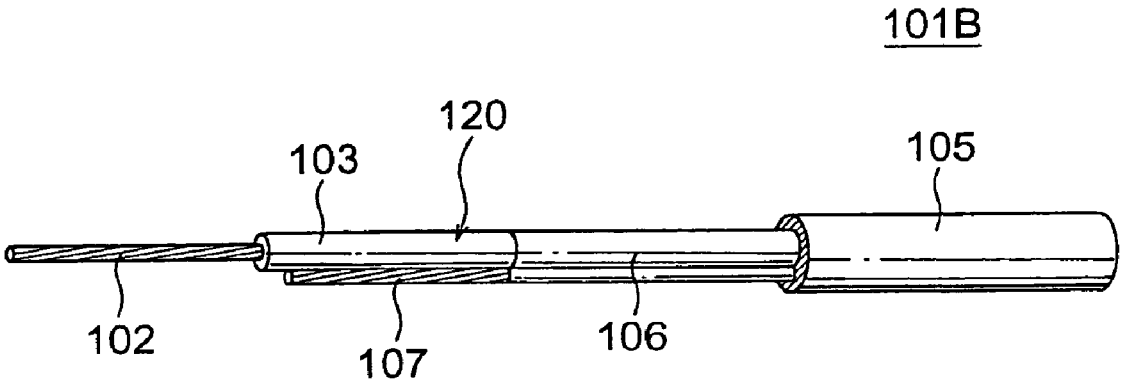
FIG. 10 is a perspective view of one shield wire including a usual drain wire.
Figure 11:
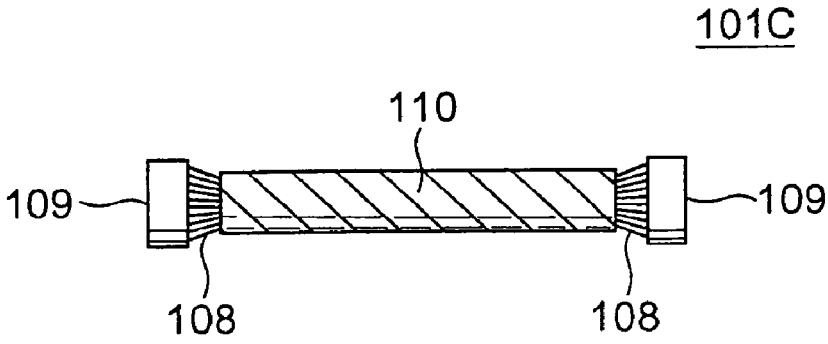
PRIOR ART FIG. 11
FIG. 11 is an illustration of the other shield wire including a usual drain wire.

An end of the metal foil shield 4B exposed by removing the sheath 5 is twisted like one stranded wire as shown in FIG. 8 and fixed on a conductive mount plate 9 for connecting to a required earth circuit 8. This terminal treatment of the metal foil shield can be processed as a usual braid shield wire. Such shield wire 1B will be used in the wiring harness and pass outer noises, which would penetrate into the core 2 of the covered wire 6, through the conductive layer of the metal foil shield 4B to the earth circuit 8, that is outside of the shield wire 1B.

According to the present invention, various terminal treatments applied to the usual braid shield wire can be applied to the metal foil shields 4A and 4B.

According to the first and second embodiments, the shield wire 1A or 1B includes one covered wire 6. According to the present invention, the shield wire can include a plurality of covered wires 6.

According to the first and second embodiments, the metal foil shield 4A or 4B is formed by providing the synthetic film on the conductive layer for enforcing the conductive layer. According to the present invention, the metal foil shield is not always required to have a synthetic resin film. In other words, the metal foil shield in the present invention means a component including at least metal foil.

In the first and second embodiments, the metal foil shield 4A having slits 41 formed linearly along the lengthwise direction N of the core 2 and the metal foil shield 4B having slits 42 formed linearly along the direction K perpendicular to the lengthwise direction N of the core 2 are described as examples. According to the present invention, slits can be formed along a direction intersecting the lengthwise direction N of the core 2, that is a direction slant to the lengthwise direction N. Furthermore, the slits 41 formed linearly along the lengthwise direction N, the slits 42 formed linearly along the intersecting direction K and slits formed linearly along the direction slant to the lengthwise direction N can be arranged in combination.

According to the present invention, it is preferable that the slits are formed linearly. Not always linearly, but the slits can be formed wave-shape.

While, in the embodiment, an only typical example of the present invention is described, it is not limited thereto. Various change and modifications can be made with the scope of the present invention.

The invention claimed is:

1. A shield wire comprising:

a covered wire having an electrical conductive core and a cover covering the core;

a metal foil shield, consisting of a conductive layer of a conductive metal and a synthetic thin film, winding around an outer surface of the covered wire; and a sheath covering around the metal foil shield, wherein the metal foil shield is provided with a plurality of slits penetrating both the conductive layer metal and the synthetic thin film of the metal foil shield.

2. The shield wire according to claim 1, wherein the slits are formed linearly along a lengthwise direction of the core, and the slits adjacent to each other with a space in a direction intersecting the lengthwise direction of the core are staggered along the lengthwise direction of the core.

3. The shield wire according to claim 1, wherein the slits are formed linearly along a direction intersecting a lengthwise direction of the core, and the slits adjacent to each other with a space in the lengthwise direction of the core are staggered along the direction intersecting the lengthwise direction of the core.

* * * * *